US010309042B2

(12) United States Patent
Erkus et al.

(10) Patent No.: US 10,309,042 B2
(45) Date of Patent: Jun. 4, 2019

(54) WOVEN FABRIC HAVING A CHANGEABLE APPEARANCE AND METHOD FOR PRODUCTION THEREOF

(71) Applicant: SANKO TEKSTIL ISLETMELERI SAN. VE TIC. A.S., Inegol, Bursa (TR)

(72) Inventors: Ertug Erkus, Inegol (TR); Hamit Yenici, Inegol (TR); Serdar Erdogan, Inegol (TR)

(73) Assignee: SANKO TEKSTIL ISLETMELERI SAN. VE TIC. A.S., Inegol Bursa (TR)

( * ) Notice: Subject to any disclaimer, the term of this patent is extended or adjusted under 35 U.S.C. 154(b) by 692 days.

(21) Appl. No.: 14/445,289

(22) Filed: Jul. 29, 2014

(65) Prior Publication Data

US 2015/0038042 A1 Feb. 5, 2015

(30) Foreign Application Priority Data

Jul. 30, 2013 (EP) ..... 13178620

(51) Int. Cl.
*D03D 15/00* (2006.01)
*D03D 1/00* (2006.01)
(Continued)

(52) U.S. Cl.
CPC ..... *D03D 15/00* (2013.01); *A41D 1/06* (2013.01); *D03D 1/00* (2013.01); *D03D 13/00* (2013.01); *D03D 13/004* (2013.01); *D03D 15/0033* (2013.01); *D03D 15/0094* (2013.01); *D03D 15/06* (2013.01); *D06B 9/00* (2013.01); *D06C 19/00* (2013.01); *D06C 27/00* (2013.01); *A41D 27/08* (2013.01); *D10B 2201/01* (2013.01); *D10B 2201/02* (2013.01);
(Continued)

(58) Field of Classification Search
None
See application file for complete search history.

(56) References Cited

U.S. PATENT DOCUMENTS 4,283,194 A * 8/1981 Teague ..... D06P 1/228 428/91
5,858,885 A 1/1999 Hamilton et al.
(Continued)

FOREIGN PATENT DOCUMENTS

CN 201212082 Y 3/2009
CN 101932761 A 12/2010
(Continued)

OTHER PUBLICATIONS

Machine translation of DE3247651, Tenge, Aug. 1984.*
(Continued)

*Primary Examiner* — Shawn Mckinnon
(74) *Attorney, Agent, or Firm* — Sughrue Mion, PLLC

(57) ABSTRACT

The woven fabric according to the invention comprises a warp and weft yarns, the weft yarns comprise first weft yarns and second weft yarns, the first weft yarns and the warp yarns form a base layer of the fabric, while the at least one plurality of second weft yarns forms an additional layer of the fabric that can be broken under a stress without damaging the base layer to change the appearance of the fabric and of the clothing articles made of said fabric.

19 Claims, 5 Drawing Sheets

(51) Int. Cl.

| | |
|---|---|
| ***D06C 27/00*** | (2006.01) |
| ***D03D 13/00*** | (2006.01) |
| ***D06B 9/00*** | (2006.01) |
| ***D06C 19/00*** | (2006.01) |
| ***A41D 1/06*** | (2006.01) |
| ***D03D 15/06*** | (2006.01) |
| *A41D 27/08* | (2006.01) |

(52) U.S. Cl.
CPC .. *D10B 2403/0114* (2013.01); *D10B 2501/00* (2013.01); *D10B 2501/04* (2013.01); *Y10T 442/3179* (2015.04); *Y10T 442/3504* (2015.04)

(56) References Cited

U.S. PATENT DOCUMENTS

| | | | |
|---|---|---|---|
| 2009/0191777 | A1 | 7/2009 | Liao |
| 2011/0212659 | A1 | 9/2011 | Yenici et al. |

FOREIGN PATENT DOCUMENTS

| | | | | |
|---|---|---|---|---|
| DE | 3247651 | | * | 8/1984 |
| DE | 44 26 555 | A1 | | 11/1995 |
| JP | 2010285736 | A | | 12/2010 |
| JP | 2013-520579 | A | | 6/2013 |

OTHER PUBLICATIONS http://www.floorstyles.com/fiber-choices-for-carpet--rugs.html, Page visited on Oct. 18, 2017.*

Ferguson, Luke, "Properties of Fibers and Fabrics", Edmonds Community College, 2009.*

European Search Report for EP 13 17 8620 dated Jan. 7, 2014.

Communication dated Jul. 10, 2018 from the Japanese Patent Office in counterpart Application No. 2014-153388.

* cited by examiner

WOVEN FABRIC HAVING A CHANGEABLE APPEARANCE AND METHOD FOR PRODUCTION THEREOF

BACKGROUND OF THE INVENTION

Field of the Invention

The present invention relates to a woven fabric having a changeable appearance and a method for the production thereof. In particular, the present invention relates to a woven fabric used to produce clothing articles.

Even if in the following particular reference to denim fabrics will be made, the present invention is not limited to this type of fabric and, in general, can be applied to any fabric having a plurality of warp yarns and a plurality of weft yarns woven together for the formation thereof according to a predetermined pattern.

Denim has enjoyed popularity in fashion industry due in particular to the finishing processes that can be applied to the fabric in order to create different appearances and thus different visible effects on the front side of the fabric, i.e. on the surface that is visible when the article made by the fabric is worn.

The exterior appearance of the fabric, and thus of the clothing article made by the fabric, can be modified by using different finishing techniques. For example, it is known in the art to coat the fabric with chemicals so as to make it impermeable or to provide different touch effects.

Other known finishing processes comprise laundry process such as the stone washing wherein the fabric is washed in a cylinder filled with pumice stones. While the wash cylinder rotates, the fabric is contacted by the stones that fall down onto the fabric.

Additionally, when a denim and in particular the indigo dyed woven fabric is used, wherein the indigo dye is located close to the surface of the yarns leaving the core of the yarns undyed, sand blast or stone wash finishing process can be applied to allow varying amounts of the undyed cores of the indigo yarns to become visible.

All the above mentioned finishing treatments allow to obtain different visible effects which make the fabric fashionable in the clothing and textile industries.

However, the finishing treatments could cause a reduction of the fabrics resistance, and thus a reduction of the life cycle of the clothing articles made by the fabric. In fact, the finishing treatments are directly carried out on the fabric and in particular on the warp and weft yarns woven together for the production thereof. Therefore the fabric will be inevitably weakened, and in general negatively affected in terms of resistance, by the known finishing treatments.

Additionally, the visible effects and appearances that can be obtained by the known finishing treatments are limited and the clothing articles made by different producers could be similar one to another, so reducing the commercial desirability of the product and the possibility to better distinguish a product from those of another producer.

SUMMARY OF THE INVENTION

An aim of the present invention is to solve the above mentioned problems and to provide a fabric, and a relative method for producing such fabric, having changeable appearances without negatively affecting the characteristics of the fabric, especially in term of resistance and life cycle duration.

Another aim of the preset invention is to provide a fabric, and a relative production method, having different visible appearances which can be obtained without increasing the overall costs of the production.

These and other aims are achieved by a woven fabric according to claim 1 that can be produced by means of a method according to claim 16. Further aspects are disclosed in the respective dependent claims.

The woven fabric according to the invention comprises a plurality of warp yarns and a plurality of first and second weft yarns woven together in a pattern forming said fabric having a front side and a back side, the weft yarns are extending over and below the warp yarns to provide correspondent over portions and under portions with respect to the warp yarns. The under portions are formed when the weft yarns pass along the back side of the fabric and the over portions are formed when the weft yarns pass along the front side of the fabric.

According to an aspect of the present invention, the plurality of first weft yarns and the plurality of warp yarns are intended to provide support to the plurality of second weft yarns. More in detail, the first yarns and the warp yarns form a base layer of the fabric, while the at least one plurality of second weft yarns forms an additional layer of the fabric. This additional layer of yarns does not contribute to the mechanical characteristics of the fabric, rather, it is a "sacrificial" layer that has the aim of being partially removed from the fabric.

As it will be disclosed later in greater detail, the at least one plurality of second weft yarns has different characteristics with respect to the first weft yarns, and/or with respect to the warp yarns, and therefore the additional layer formed by the second weft yarns has a different behavior when a stress is applied on the fabric with respect to the first weft yarns and/or the warp yarns.

The fabric according to the invention is characterized in that under an external stress applied to at least one area of the fabric at least part of the second weft yarns is broken and/or removed from the fabric while the first weft yarns withstand the same external stress.

The expression "external stress" is used herein to indicate that the fabric is subjected to a stress, i.e. an action, that is applied on it manually or automatically, and that is selected from mechanical stresses, such as abrasion and wear for example by means of a tool or a suitable device including pumice stones, and chemical stresses, including use of detergents, solvents, bleach and including combustion of the second weft yarns, e.g. combustion by flame or by laser. As a result of the different behaviour of the second weft yarns with respect to first weft yarns and warp yarns, and due to their different characteristics, especially in terms of breaking strength, possibly also of count and tensile strength, the response to the same applied stress will be different and will result in an at least partial removal of the second weft yarns from the fabric.

More in detail, according to the invention the applied stress causing the second weft yarns to break, is not able to break (or burn, damage or dissolve) the first weft yarns.

In other words, the first weft yarns withstand an external stress that causes the break of the second weft yarns. It has to be noted that, according to an aspect of the present invention also the warp yarns are able to withstand, without breaking, the stress that causes the second weft yarns to break. According to another aspect of the invention, the same stress, or another type of stress, e.g. abrasion, may be applied to the area from which the second weft yarns have already been removed in order to damage (e.g. by making a hole) the base fabric of warp and first weft yarns.

As previously mentioned, the stress is applied on the side of the fabric that corresponds to the visible side of the clothing article or garment made with the invention fabric and breaks and removes at least part of the over portions of the second weft yarns that are on said side of the fabric. In order to further facilitate the removal of the second weft yarns from the visible side of the fabric, the overportions of the second weft yarns are relatively long and the underportions are as short as possible. The second weft yarns are advantageously woven so as to form over portions along the front side of the fabric by passing over at least two or more warp yarns, preferably at least three, more preferably by passing over four, five or more warp yarns, and most preferably by passing over seven or more warp yarns.

It has to be noted that the length of the over portions formed by the second weft yarns, depending on the number of warp yarns passed, cannot be too short because in this case it would be more difficult to break the second weft yarns by the stress applied to the fabric.

In other words, if the length of the over portions formed by the second weft yarns is too short it would be difficult to apply an external stress able to break only the second weft yarns without affecting the first weft yarns and/or the warp yarns.

According to a preferred aspect, the maximum length of the overportions of the second weft yarns is that required to form over portions along the front side of the fabric by passing over up to twenty warp yarns, and preferably by passing over up to fifteen o thirteen warp yarns. A preferred range for the overportions is a passing over from 4 to 12 warp yarns in the fabric.

It was found by the Applicant, that the above reported minimum and maximum lengths of the over portions formed by the second weft yarns allow to obtain an effective break of the desired part of the second weft yarns, and at the same time the over portions are not too long and do not negatively affect the aesthetic appearance of the fabric by providing too loose (i.e. too long) over portions.

Advantageously, the presence of at least one second plurality of weft yarns allows to change the external visible appearance of the fabric. In fact, the second weft yarns, compared to the first weft yarns, can be easily broken and thus at least partially removed from at least one area of the fabric external side (front side of the clothing garment).

In fact, the additional layer formed by the second weft yarns can be easily removed from at least part of the fabric surface so that the base layer formed by the first weft yarns and the warp yarns become visible. In other words, the second weft yarns covers, thus forming an additional—breakable—layer, the base layer made of the first weft yarns and the warp yarns. By applying a suitable external stress to the fabric, for a suitable amount of time, the break of the additional layer made by the second weft yarns will be caused, while the first weft yarns and the warp yarns are able to withstand the same stress without breaking. By doing so, it is possible to remove the second weft from the side of the fabric, preferably from the front side of the fabric that corresponds to the external visible side of the clothing article made by the fabric. Advantageously, by applying said stress to the fabric able to break only the second weft yarns, it is possible to provide different visual effects on the fabric front side without negatively affecting the first weft yarns and the warp yarns making up the base layer of the fabric, that are not weakened external stress applied to the fabric. A preferred fabric is a denim fabric, independently of the colour of the fabric.

According to an aspect of the preset invention, the stress to be applied is abrasion. In this embodiment, the breaking force of the second weft yarns is lower than the breaking force of the first weft yarns and lower than that of the warp yarns. Preferably, the breaking force of the second weft yarns is from 3 to 7 times lower than the tensile strength of the first weft yarns, preferably 3 to 5 times lower; in other words the ratio of breaking force for first weft yarns to breaking force for the second yarns is in the range of 2:1 to 7:1, preferably 3:1 to 5:1. In any case, the breaking force of the second yarns should be sufficient to have the yarn woven without breaking in the process.

Breaking force is measured in N or in cN, e.g. with an USTER® TENSO JET 4 or USTER® HVI test instrument. The breaking force, or B-Force is measured as the maximum tensile force measured at Constant Rate of Extension in the graph of force vs elongation until the yarn breaks. Further details of these instruments and the way they operate the required measures can be found in the publication "G. Peters, S. Meier, USTER® Laboratory Systems, Application Report, *Description of all quality parameters measured by Uster Technologies fiber and yarn testing equipment*, Edition 3: July 2010. This publication refers to ASTM D-1445 for testing breaking force, but other testing methods and parameters may be used, considering that the requirement is a ratio of the values of breaking forces for first and second yarns.

Advantageously by providing second weft yarns, having a lower breaking force with respect to the first weft yarns, it is possible to break the desired second weft yarns to easily provide different visual effects using an amount of stress applied on the fabric that does not affect the basic layer of the fabric made by the first weft yarns and the warp yarns. These advantages are particularly evident in the above mentioned range of difference of the values of the breaking force between the second and first weft yarns.

Additionally, according to another aspect of the present invention, the second weft yarns may be finer than the first weft yarns and the count of the second weft yarns differs from 5 to 8 times from the count of the first weft yarns. In other words, the count of second weft yarns is lower from 5 to 8 times with respect to the count of the first weft yarns.

The second weft yarns count can be different depending on the yarn material, for example if cotton is used the count can be up to 30Ne, and if kapok is used the count can be 10Ne.

The present invention also relates to a method for the production of a woven fabric according to the invention, briefly disclosed above. The method comprises the steps of weaving together warp yarns and weft yarns, wherein the weft yarns comprise a plurality of first weft yarns and a plurality of second weft yarns, to form a fabric provided with a front side and a back side.

The plurality of warp yarns and the plurality of first weft yarns form a base layer of the fabric and the at least one second plurality of weft yarns form an additional layer of the fabric on the front side of the fabric.

The method is characterized by comprising the step of applying an external stress to at least one area of said fabric to break at least part of said second weft yarns, wherein the second weft yarns have a lower resistance to said stress than said first weft yarns, so that said first weft yarns withstand the same external stress applied to the fabric that causes the break of at least part of said second weft yarns.

Preferably, the external stress is applied by a superficial treatment that does not affect the base layer and in particular the first weft yarns and the warp yarns used to form the base layer of the fabric that can maintain their characteristics as in the case the fabric is not subjected to finishing treatments.

In other words, an advantage of the method according to the invention, and of the fabric thus obtained, is that the finishing treatment is carried out on an additional breakable layer made by the second weft yarns, and thus the finishing treatments intended to break the second weft yarns 4 does not negatively affect the yarns woven together to form the fabric and in particular the base layer of the fabric.

According to an aspect of the present invention, the stress is abrasione and the step of applying an external stress to at least an area of said fabric is carried out by abrading at least one area of a side of the fabric, namely the fabric front side, to break and remove at least in part said second weft yarns. In fact, as mentioned above, the second weft yarns are woven to form over portions on the front side of the fabric thus providing said additional breakable layer.

It has to be noted that possible processes intended to break the second weft yarns of the fabric in said step of applying an external stress to at least one area of the fabric, can be selected from: laundry process, the application of chemicals products, the use of scraping sand papers, stone wash process, burning as per flame burning or laser treatment process, or by a combination of two or more of said processes.

As already mentioned above, in any case the applied stress on the fabric is able to break at least part of the second weft yarns, while the first weft yarns are able to withstand the same stress, due to different characteristics between the first and second weft yarns, e.g. in terms of count and breaking force, as discussed above.

The present invention also relates to clothing articles made by a woven fabric according to the invention. According to a preferred aspect, the front side of the fabric is the external visible side of the article when the latter is worn, and the back side is the internal not visible side when the article is worn. By doing so, the second weft yarns extending on the front side of the fabric will be visible and in the area where the stress is applied, said second weft yarns will break in order to make visible the base layer of the fabric made of the woven first weft yarns and warp yarns.

The use of a fabric according to the invention having at least one plurality of second weft yarns allow to obtain clothing articles having different appearances that can be also customized to specific client requests. Advantageously, the application of the stress to the fabric can be done at the end of the fabric or article production, and also by the final user of the article.

BRIEF DESCRIPTION OF THE DRAWINGS

These and other advantages and features of the present invention will be more apparent from the description below, provided with reference to the accompanying drawings, purely by way of a non-limiting example, wherein.

DETAILED DESCRIPTION OF THE INVENTION

Figure 1:
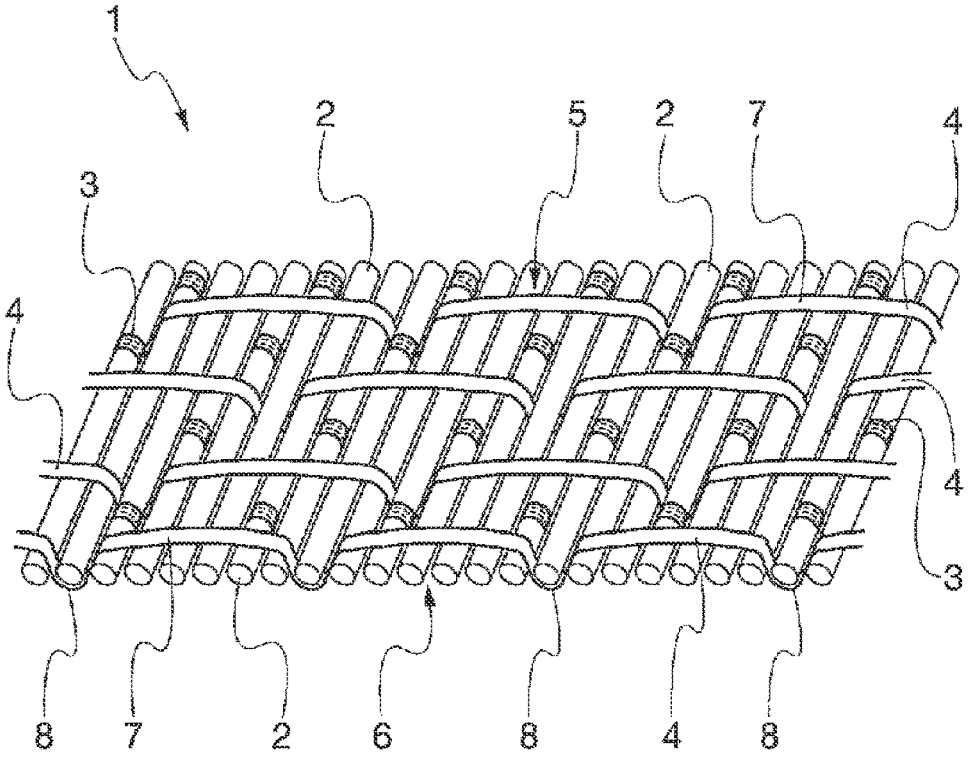
FIG. 1 is a perspective view of a portion of a possible embodiment of the fabric according to the present invention.

With reference to the attached figures, the woven fabric 1 according to the invention comprises a plurality of warp yarns 2 and a plurality of weft yarns 3, 4 woven together in a pattern forming said fabric having a front side 5 and a back side 6.

At least a plurality of first weft yarns 3, and a further plurality of second weft yarns 4 are used, whereby the weft yarns of the first plurality 3 are different from the weft yarns of the second plurality 4. In particular, according to the invention there may be more than one plurality of second yarns, having different characteristics such as resistance to stress, color and weaving pattern.

As disclosed with reference to a clothing article 10 according to the invention made, the front side 5 of the fabric corresponds to the external visible side of the article when the latter is worn. In other words, the front side 5 of the fabric will be arranged during the production to become the external side of the article.

The weft yarns 3, 4 of the fabric 1 are extending over and below the warp yarns 2 to provide correspondent over portions 7,7' and under portions 8,8' with respect to the warp yarns 2. As shown in the figures, the under portions 8, 8' are formed when the weft yarns 3, 4, respectively, pass along the back side 6 of the fabric and the over portions 7, 7' are formed when the weft yarns 3, 4, respectively, pass along the front side 5 of the fabric.

Figure 3:
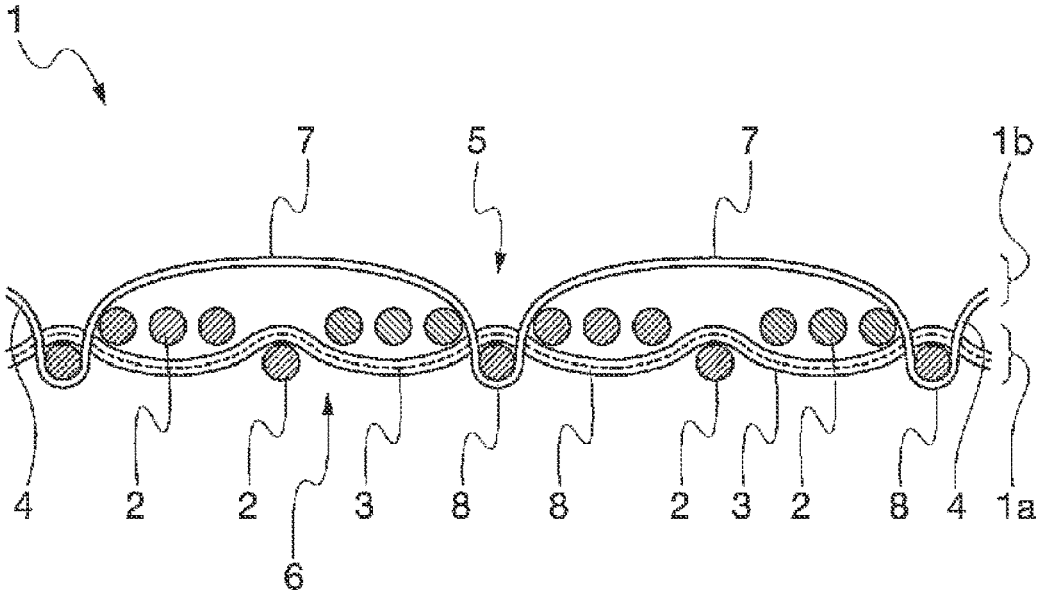
FIG. 3 is a cross sectional view of a portion of the fabric according to FIG. 1.

Over portions 7, 7' and under portions 8, 8' are better shown in FIG. 3 that is a cross sectional view of a possible embodiment of a fabric according to the invention.

According to a preferred aspect, the weft yarns of the fabric 1 comprise a plurality of first weft yarns 3 that are woven together with the warp yarns 2 to form a base layer 1*a* of the fabric, and at least one second plurality of weft yarns 4 forming an additional layer 1*b* of the fabric (see in particular the cross-sectional view of FIG. 3).

In a preferred embodiment, the woven fabric according to the invention is a denim fabric, preferably a twill denim fabric, more preferably the warp yarns are indigo dyed, most preferably ring dyed, so that a denim fabric is produced with warp yarns and the first weft yarns. However, the present invention is not limited to such type of fabric.

According to a possible embodiment, the warp yarns 2 and the first weft yarns 3 are woven to form a warp faced twill fabric. In other words according to a possible embodiment of the present invention, the first weft yarns 3 and the warp yarns 2 are woven to form a base layer of the fabric in the form of a warp faced twill fabric, i.e. a twill fabric wherein the warp yarns are externally visible. This type of twill weave fabric is well known in the art and can be provided with different patterns depending on the reciprocal arrangement in terms of passed yarns and reciprocal cross of the warps yarns and of the first weft yarns in the weave pattern.

According to an aspect of the present invention, the first weft yarns 3 extend to form under portions 8 along the back side 6 of the fabric by passing below two or more warp yarns 2, thus forming a warp faced twill fabric. In the embodiment shown in FIGS. 1-3, the first weft yarns 3 pass below three warp yarns 2 and above a single warp yarn 2.

As previously discussed, the yarns of said at least one plurality of second weft yarns 4 have a resistance to a selected type stress, usually selected from abrasion, washing, chemical attack, flame burning and laser treatment, that is lower than the yarns of the plurality of first weft yarns 3, so that at least part of the second weft yarns 4 break under an external stress applied to at least one area of the fabric provided with said second yarns.

Figure 2:
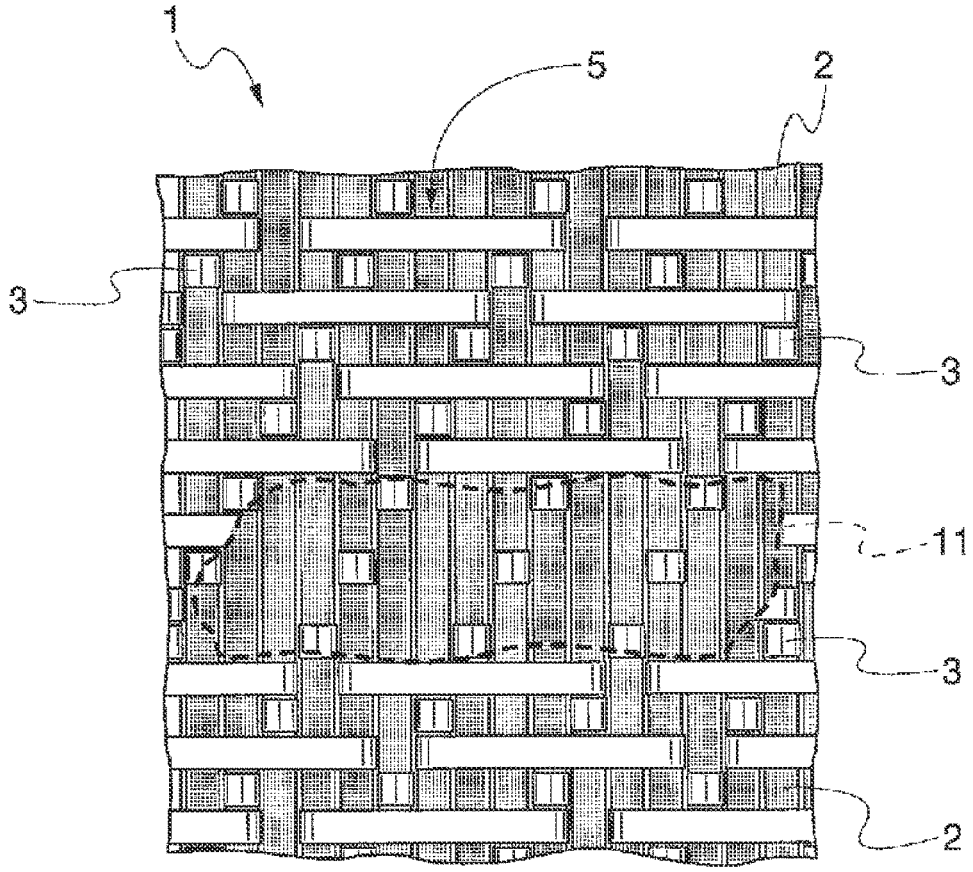
FIG. 2, is a view of the front side of a portion of the fabric according to FIG. 1.

FIG. 2 is a view of the front side 5 of a possible embodiment of a fabric 1 according to the invention that is provided with a part, or area 11, wherein the second weft yarns 4 have been broken and then removed. In this area 11 of the front side 5 of the fabric the first weft yarns 3 and the warp yarns 2 are visible.

According to the invention, the first weft yarns 3 are able to withstand the same external stress that is causing the break of the second weft yarns 4. It has to be noted that according to a preferred aspect of the present invention, also the warp yarns 2 are able to withstand the external stress causing the break of the second weft yarns 4, i.e. warp yarns 2 and first weft yarns 3 behave in a similar way under the selected type of stress. As mentioned, a preferred type of stress is mechanical, by abrasion; in this embodiment, second weft yarns 4 have a breaking strength that is lower than the breaking strength of warp yarns 2 and first weft yarns 3.

Devices suitable for preparing the fabric according to the invention, due to the presence of at least one second plurality of weft yarns, are eccentric looms, Dobby looms and Jacquard looms. Suitable yarns for the warp yarns are known in the art, e.g. cotton yarns, mixed fibers yarns etcetera. Suitable yarns for the first weft yarns are also known in the art, e.g. cotton yarns, mixed fibers yarns, elastic yarns, such as yarns having an elastic core and a staple fiber coating around the core. Suitable yarns for the second yarns are cotton yarns, kapok yarns, mixed yarns, synthetic yarns; preferably second weft yarns are not elastic.

As mentioned above, the yarns of the—at least one—plurality of second weft yarns 4, i.e. the "second weft yarns", have a lower breaking force (and possibly also a lower count) with respect to the yarns of the plurality of first weft yarns 3, so that the second weft yarns 4 are weaker and possibly also finer, than the plurality of first weft yarns 3. According to a preferred embodiment, breaking force, and possibly also count, of the second weft yarns is lower than the tensile strength and count of the warp yarns 2.

In other words, according to an aspect of the invention the second weft yarns 4 are less resistant (due to a lower breaking force) and preferably also finer (due to a lower count) than the first weft 3 yarns and also with respect to the plurality of warp yarns 2.

By doing so, the second weft yarns 4 form at least one additional layer 1*b* that has yarns that can be broken or damaged in a visible way (e.g twisted or eroded) in correspondence of at least one area 11 of the fabric, in order to make visible the underlying base layer of the fabric formed by warp yarns 2 and first weft yarns 3. The result is the possibility of imparting different and changeable appearances and effects to the fabric and, most important, to the clothing article produced from said fabric.

The external stress applied to the fabric is able to break the second weft yarns 4 but not the first weft yarns 3 and/or the warp yarns 2. Therefore, according to the invention, the external visible effect of the fabric can be obtained without affecting the base layer 1*a* of the fabric, wherein the first weft yarns 3 and the warp yarns 2 maintain their characteristics, contrarily to the known finishing treatments wherein the warps and weft yarns forming the fabric are directly subject to said finishing treatments.

Figure 4:
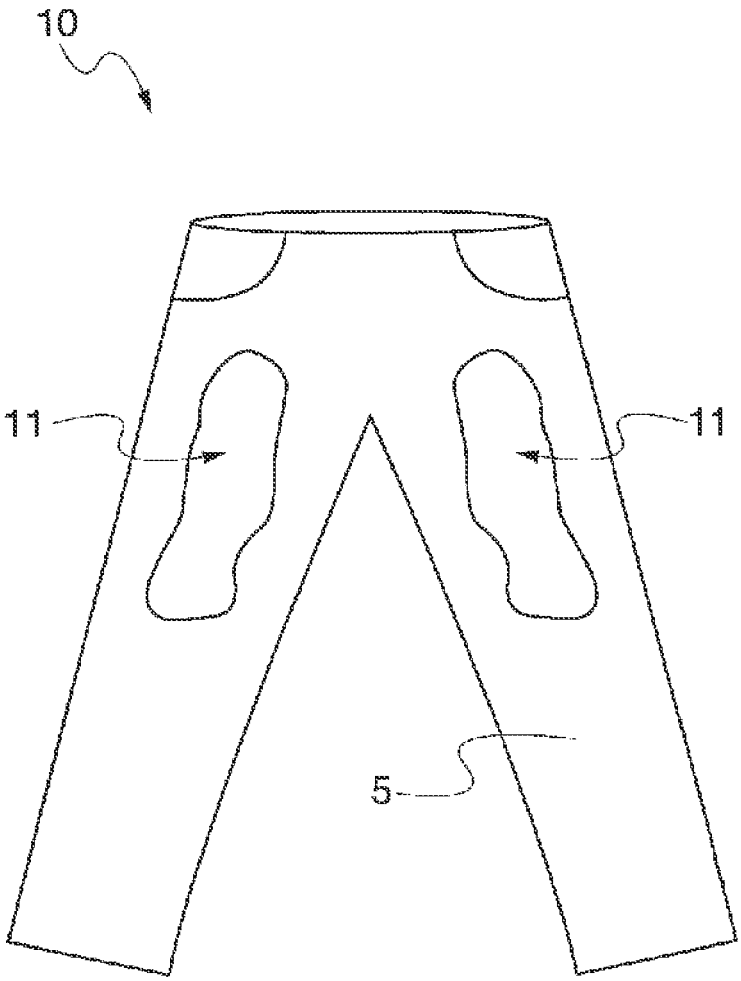
FIG. 4 is a schematic top view of a possible embodiment of a clothing article according to the invention.

Preferably, the broken second weft yarns 4 are removed from the fabric 1, as shown in the area 11 of the embodiment shown in FIGS. 2 and 4.

Preferably, the strength of the second weft yarns 4 is selected equal or 10-20% greater than the minimum breaking force that allows the second weft yarns 4 to be woven without breaking during the weaving process, but the breaking force may be greater, according to the final effect required and to the finishing treatment process used.

As known in the art, the breaking force mainly depends on the material with which the second weft yarns are made, but also the characteristics of the loom and the weaving techniques to be used may play a role in the selection of the desired characteristics of the yarn, especially in the case of the second weft yarns 4 that need to be easily broken under an external stress.

According to a preferred embodiment, the breaking force of the second weft yarns 4 is from 2 to 5 times lower than the tensile strength of said first weft yarns 3. A suitable tensile strength of said second weft yarns 4 is in the range of 300 to 600 cN.

Additionally, according to an aspect of the present invention, the count of said second weft yarns 4 differs from 5 to 8 times with respect to the count of said first weft yarns 3. It has to be noted that the count of the second weft yarns 4 can be different according to the material used to make said second weft yarns 4. In fact, if cotton is used to make the second weft yarns 4, the count can be chosen equal or above 30 Ne, where Ne is the English cotton number that is a known count unit used in the textile field.

However, if kapok is the material used for the second weft yarns 4, the count can be chosen around 10 Ne, because kapok is a very weak yarn so that a thicker yarn can be used to form the breakable layer made by the second weft yarns 4.

In general, it has to be noted that the second weft yarns 4 are finer than the first weft yarns 3 and preferably also finer than the warp yarns 2, so that, in addition to having different mechanical characteristics, the second weft yarns let part of the basic fabric, i.e. the fabric made by warp yarns 2 and first weft yarns 3, be visible trough the layer 1*b*.

In the present disclosure, the expression "external stress" is used herein to indicate that the fabric is subjected to a stress that is applied to it manually or automatically, for example by means of a tool or a suitable device; this term also encompasses action by chemicals, i.e. the stress may be mechanical or chemical. As it will be discussed later in connection to the method for the production of the fabric according to the invention, possible suitable processes intended to break the second weft yarns of the fabric can be selected from: laundry process, the application of chemicals products, the use of scraping sand papers, stone wash process, flame burning or laser treatment process, or by a combination of two or more of said processes. Preferably, the external stress is applied to at least an area of said fabric by treating at least one area of a side of the fabric, preferably the fabric front side 5, to break and remove at least in part said second weft yarns 4.

Preferably, the external stress is applied by a superficial treatment that does not affect the base layer 1*a* and in particular the first weft yarns 3 and the warp yarns 2 used to form said base layer of the fabric. By doing so, the first weft yarns 3 and the warp yarns 2 maintain their characteristics as in the case the fabric is not subjected to finishing treatments, or the changes to their characteristics are reduced.

A preferred stress is abrasion, that can be carried out in known ways but that may occur also during washing, in a lesser degree than by scraping. In an embodiment, abrasion may occur naturally, following the normal wear of the article of clothing. Stress may be applied chemically, e.g. by selecting a fiber for the second weft yarns that can be broken by exposure of the final fabric, or clothing article, to e.g. basic or acidic pH conditions, or to bleaching conditions. In the case of a chemical stress, breaking force of the yarns is less important that when the stress is a mechanical one.

According to the invention, the second weft yarns 4 extend on the front side 5 of the fabric in order to form said breakable additional layer.

More in detail, the fabric is provided with second weft yarns 4 extending to form over portions 7' along the front side 5 of the fabric by passing over two, preferably four or more warp yarns 2, and preferably by passing over five or more warp yarns 2, and more preferably by passing over seven or more warp yarns 2 (see in particular the cross-sectional view of FIG. 3).

This weave configuration allows to obtain over portions 7' of the second weft yarns 4 the length of which is enough to be broken easily. In other words, by passing over at least two preferably at least four, or five or more, and more preferably seven or more warp yarns 2, the over portions 7' of the weft yarns, forming the additional layer 1*b* of the fabric, over the front side 5, can be easily broken by the mentioned external stress. It has to be noted that a reduced extension of the over portions 7 makes more difficult to break the second weft yarns 4. Additionally, it should be noticed that the change in the appearance of the fabric between the area with intact second yarns and the areas 11, where second yarns are broken and removed, is more dramatic if the over portions 7' of yarns 4 pass over at least four warp yarns.

Preferably, the second weft yarns are extending below the warp yarns 2 by passing a single warp yarn. In the art the passage below a single warp and above 3, 5 or 7 warps is known as 3/1, 5/1, 7/1 configurations that means respectively, two up one down, five up one down, and seven up one down, to indicate the numbers of warp yarns 2 passed respectively on the front side 5 and the back side 6 of the fabric 1.

In the embodiment shown in FIGS. 1-3 the second warp yarns 4 pass above seven warp yarns 2 thus forming a plurality of over portions 7' on the front side 5 of the fabric 1 in a 7/1 configuration.

According to possible embodiments of the fabric 1, the second weft yarns 4 extend to form over portions 7' along the front side 5 of the fabric by passing over up to twenty warp yarns 2, and preferably by passing over up to fifteen warp yarns 2. All the above features can be combined, by having different lengths of the over portions 7'.

As already mentioned above, different materials and types of yarns may be used for the production of the fabric 1. More in detail, concerning the type of warp yarns 2 and/or first weft yarns 3, they can be made by single and/or twisted yarns. Because of the second weft yarns 4 need to be weaker than the first yarns, preferably the second weft yarns 4 are made by single yarns.

Concerning the materials that can be used to make the yarns of the fabric according to the invention, they can be selected from both natural fiber and synthetic fiber, and/or a mixture thereof.

In an exemplary embodiment, the second weft yarns 4 are made by a different material with respect to the first weft yarns 3 and/or the warp yarns 2. Moreover, the second weft yarns 4 may advantageously have different color, or a different color gradation, with respect to the first weft yarns 3 and/or the warp yarns 2 to obtain enhanced visual effects on the front side 5 of the fabric.

For example, if the base layer 1*a* of the fabric is a denim indigo dyed fabric, the external appearance will be provided by the color of the second plurality of weft yarns 4 forming the at least one additional layer 1*b*, that is visible on the front side 5 of the fabric.

By breaking the second weft yarns 4 in at least one area of the front side surface of the fabric 1 (as for example in the area 11 of the embodiment shown in FIG. 2), the color of the indigo dyed fabric formed by the first weft yarns 3 and the warp yarns 2 will become visible only in the area where the second weft yarns 4 are broken and removed from the fabric 1. Removal is generally simultaneous with breaking of the second weft yarn (laser treatment, burning, chemical attack) or non-simultaneous, as by abrasion, where the unremoved, broken yarns are eventually removed by washing. For example, according to a possible embodiment, the second weft yarns 4 can be provided with a lighter color compared to the color of the base fabric layer 1*a*, formed by warp 2 and weft 3; alternatively second weft yarns 4 mat be of a color darker than the color of the base fabric 1*a*.

All the above features may be combined to provide a layer 1*b* with over portions 7' of different materials, different colours and different lengths. Advantageously, the second weft yarns 4 are generally woven for the entire extension of the base layer 1*a* of the fabric formed by the warp yarns 2 and the first yarns 3, but it can also extend only for a reduced area of the base layer 1*a* of the fabric made by warp yarns and the first weft yarns or in alternate pattern or in a random way. In other words, according to different possible embodiments, the additional layer 1*b* formed by the second weft yarns 4 may extend on the entire surface of the base layer 1*a*, or it can be provided with a reduced superficial extension thus covering only a desired part of the base layer 1*a* of the fabric.

Figure 5:
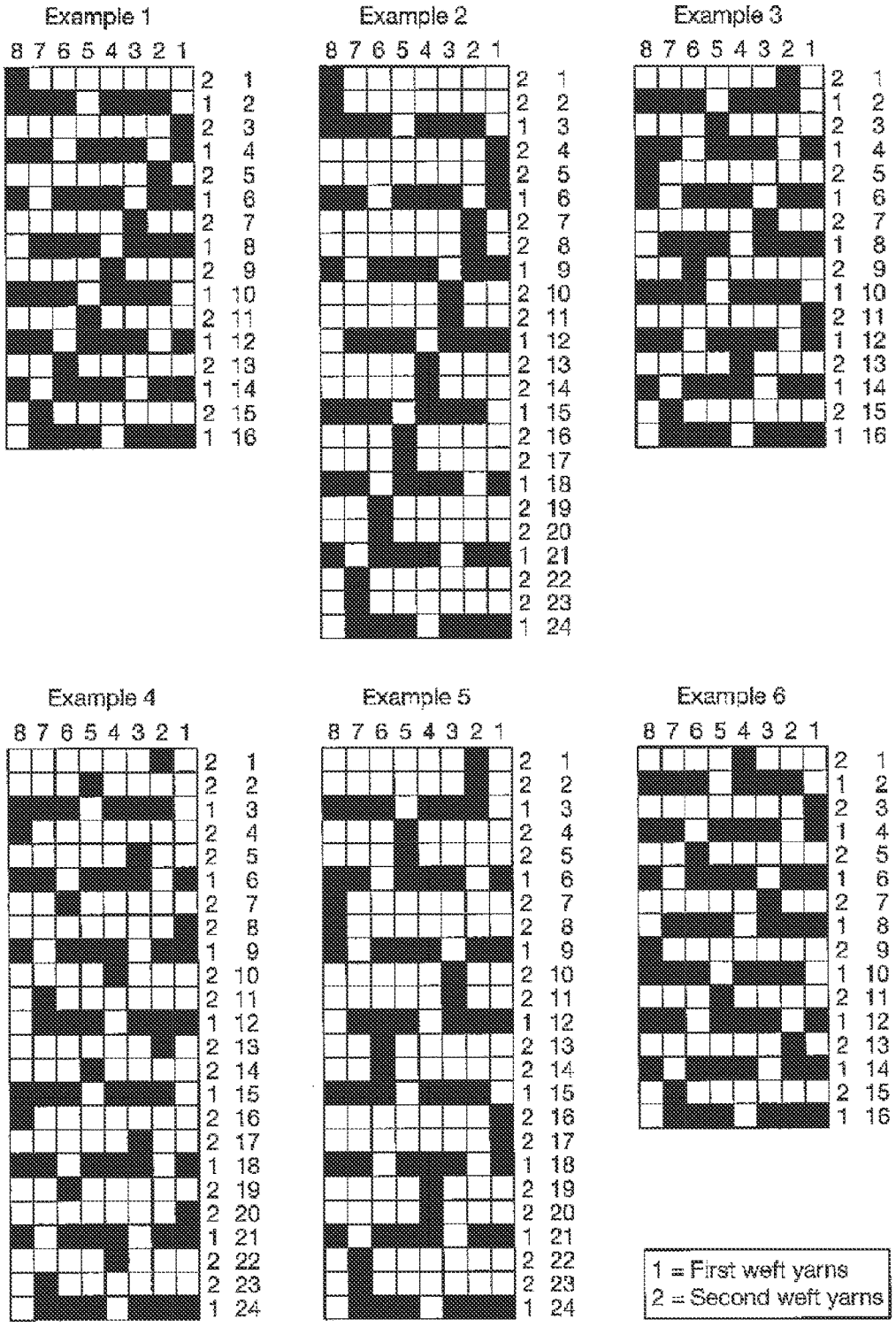
FIG. 5 shows six weave reports of correspondent exemplary embodiments of the fabric according to the invention.

FIG. 5, shows six examples of weave reports suitable for the fabrics according to the examples. As known in the art, a weave report reproduces a graphic rendition of the minimum repeat unit of the pattern of the fabric. In other words, a repeat unit shows a unitary portion of the pattern of the fabric that is repeating along the fabric extension.

In particular, the fabric 1 shown in FIGS. 1-3 is constructed as indicated in the wave report of example 3. Additionally it has to be noted that in the weave reports shown in FIG. 5, number 1 identifies the first weft yarns and number 2 identifies the second weft yarns, see the first column of numbers on the right side of each weave report. The number alternations corresponds to the alternation of first and second weft yarns along a direction parallel to the direction of the warp yarns extension of the fabric pattern.

EXAMPLES

The following two examples relate to two different fabrics made according to the weave report of example 6 of FIG. 5. For the two fabrics prepared, the following yarns were used; values hereinbelow are given as average values. All the yarns are cotton yarns.

Yarn 1.

Ne 7/1:
RKM: 17 cN/tex
Break Force: 1500 cN

Yarn 2.

Ne: 8/1
RKM: 19 cN/tex
Break Force: 1400 cN

Yarn 3.

Ne: 10/1

RKM: 20 cN/Tex

Break Force: 1100 cN

Yarn 4.

Ne 50/1

RKM: 27 cN/Tex

Break Force: 400 cN

Yarn 4 was used as the second weft yarn, as can be seen from its low value of breaking force.

Fabric 1

Light Weight Construction. Values for Finished Unwashed Fabric.

Warp Yarn Count: NE 10/1 Ring Slub

1. Weft Yarn Count: Ne 10/1 Ring

2. Weft Yarn Count: Ne 50/1 Ring

Warp Density: 28.8 thread/cm

Weft Density: 39.3 picks/cm

Weight unwashed: 350 gr/mt$^2$

Fabric 2

Heavy Weight Construction. Values for Finished Unwashed Fabric

Warp Yarn Count: NE 8/1 Ring Slub

1. Weft Yarn Count: Ne 7/1 Ring

2. Weft Yarn Count: Ne 50/1 Ring

Warp Density: 29.8 thread/cm

Weft Density: 40.5 picks/cm

Weight Unwashed: 430 gr/mt$^2$

Fabrics 1 and 2 were prepared as denim fabrics; they were washed and used to prepare trousers that were subjected to stone washing. The resulting trousers showed areas of removal of the second weft yarns distributed on the trousers, with greater areas on the upper part of the legs. The length of the stone washing treatment time could be dramatically reduced with respect to the time requested to have a similar effect on traditional trousers.

As previously mentioned, the fabric of the invention is used to make a clothing item. The external stress may be applied to the fabric before making the clothing article 10, but preferably the stress is applied to the clothing article, in order to break the layer 1*b* of second weft yarns in selected areas 11.

Thus, the present invention also relates to clothing articles 10 made by a woven fabric 1 according to the invention and aims to protect the clothing article (as well as the fabric) both with an integral layer 1*b* of second yarns 4 and with a layer of second yarns 4 that are broken in some areas 11. FIG. 4 schematically shows a pair of trousers 10 made of a fabric 1 according to the invention, e.g. a denim fabric; different clothing articles such as, shirts, skirts, etc can be made from the invention fabric.

According to the invention, the front side 5 of the fabric is the external visible side of clothing article 10 when the latter is worn, and the back side of fabric 1 is the internal not visible side of clothing article 10, when the article is worn. By doing so, the second weft yarns 4 extending on the front side 5 of the fabric 1 will be visible and, in the area where the stress is applied, said second weft yarns 4 will break in order to make visible the base layer 1*a* of the fabric made of the woven first weft yarns 3 and warp yarns 2. Broken yarns 4 may be also visible, if not removed from the fabric.

According to an aspect of the invention, in its final condition the clothing article 10 comprises at least one area of said external visible side 5 wherein the second weft yarns 4 have been broken and removed from the fabric 1. In the embodiment shown in FIG. 4, the trousers 10 are provided with areas 11 arranged in correspondence of the legs of the trousers 10 where the second weft yarns 4 have been broken and subsequently removed so that the base layer 1*a* (made by woven warp yarns 2 and the first weft yarns 3) is visible.

In general, the clothing articles 10 can be provided with different areas 11 where the second weft yarns 4 have been broken and removed, said area or areas can be arranged on different positions on the front side (i.e. the external visible surface) of the clothing article.

Additionally, as already mentioned above, the second weft yarns 4 can be woven on at least part of the fabric and in particular on at least part of the base layer 1*a* of the fabric made by the first weft yarns 3 and the warp yarns 2. In the embodiment shown in FIG. 4 the second weft yarns are woven to cover the complete front side 5 of the fabric, and then they are broken and removed from the desired portion or portions (area or areas 11) thereof.

The way to break and remove yarns 4 from the fabric's external side are e.g. those previously discussed; in an exemplary embodiment, yarns 4 are weak enough to be "scratched" by the normal wear and tear that occurs when the clothing item is worn and used. In this embodiment, therefore, the trousers, or other item, will change its appearance with use, because of wearing of the fabric, in a much quicker way than it happens with trousers made of traditional fabric. This is a distinctive advantage of the invention.

The present invention also relates to a method for producing a fabric 1 according to the invention and above discussed, also with reference to the exemplary embodiments. The method comprise the steps of weaving together a warp yarns 2 and weft yarns 3, 4, wherein the weft yarns are comprising a first and at least a second plurality of weft yarns 3 and 4, to form a fabric wherein the yarns of the second plurality extend on the front side of the fabric and are provided with a resistance to stress, e.g. a breaking force that is lower than the resistance of the remaining yarns of the fabric to the same stress.

Preferably, the second weft yarns 4 are woven by passing over three, preferably four or more warp yarns 2, and more preferably by passing over seven or more warp yarns 2. According to an aspect, the second weft yarns 4 are woven to extend to form over portions 7 along the front side 5 of the fabric by passing over up to a maximum of twenty warp yarns 2, and preferably by passing over up to fifteen warp yarns 2, most preferably 12 warp yarns.

The plurality of warp yarns 2 and the plurality of first weft yarns 3 form a base layer 1*a* of the fabric and the least one second plurality of weft yarns 4 forms an additional layer 1*b* of the fabric that, as already discussed above, can be broken and optionally removed from the fabric without damaging the remaining yarns of the fabric.

The invention also relates to a process of preparing a clothing article, comprising the step of providing a fabric as above discussed, manufacturing a clothing article from said fabric, and applying an external stress to at least one area of the fabric of said clothing article to break at least part of said breakable second weft yarns 4.

The external stress is applied by a superficial treatment that does not affect or that affects in a reduced amount the base layer 1*a*, and in particular the first weft yarns 3 and the warp yarns 4 used to form the base layer of the fabric. By doing so, the first weft yarns 3 and the warp yarns 2 maintain their characteristics as in the case the fabric is not subjected to finishing treatments.

According to an aspect of the present invention, the step of applying an external stress to at least an area of said fabric is carried out by abrading at least one area 11 of a side of the fabric, preferably the fabric front side 5, to break at least in part said second weft yarns 4. In fact, as mentioned above, the second weft yarns 4 are woven to form over portions 7 on the front side of the fabric thus providing said additional breakable layer 1*b*, see for example the cross sectional view of FIG. 4.

It has to be noted that possible process intended to break the second weft yarns 4 of the fabric in said step of applying an external stress to at least an area of the fabric, can be selected from: laundry process, the application of chemicals products, the use of scarping sand papers, stone wash process, flame burning or laser treatment process, or by a combination of two or more of said processes.

As already mentioned above, in any case the applied stress on the fabric 1 is able to break at least part of the second weft yarns 4, while at least the first weft yarns 3 are able to withstand the same stress, due to different characteristics between the first and second weft yarns, especially in terms of count and tensile strength, as discussed above.

FIG. 2 is a view of the front side 5 of a possible embodiment of a fabric 1 according to the invention that is provided with a part, or area 11, wherein the second weft yarns 4 have been broken and then removed. In this area 11 of the front side 5 of the fabric the first weft yarns 3 and the warp yarns 2 are visible.

In fact, according to an aspect of the present invention, the method comprises the further step of removing from the fabric said broken second weft yarns 4; removal may be carried out during the step of applying said external stress on at least one area of the fabric 1 or after that step, to increase change in the appearance of the clothing article.

The invention claimed is:

1. A clothing article (10) comprising a woven fabric (1) comprising warp yarns (2) and weft yarns (3, 4) woven together, said fabric having a front side (5) and a back side (6) wherein said front side (5) of the fabric (1) is the external side of the clothing article when the article is worn, and said back side (6) is the internal not visible side when the article is worn, wherein: said weft yarns comprise a plurality of first weft yarns (3) and at least one plurality of second weft yarns (4); said plurality of warp yarns (2) and said plurality of first weft yarns (3) form a base layer (la) of said fabric; and said at least one plurality of second weft yarns (4) form an additional layer (1*b*) of said fabric in the form of over portions (7'), characterized in that said an additional layer (1*b*) is located on the front side (5) of the fabric and in that said first (3) and second (4) weft yarns are different and are selected to give a different behaviour with respect to a same stress applied to an area of said fabric, so that at least part of said second weft yarns (4) in said additional layer (1*b*) of the fabric breaks under said stress applied to at least one area (11) of said fabric and at least said first weft yarns (3) of said base layer (1*a*) within said areas (11) withstand the said stress, and wherein at least a portion of the second weft yarns are broken and at least part of at least some of the broken second weft yarns is removed from the fabric.

2. The clothing article according to claim 1, wherein said stress is a mechanical stress.

3. The clothing article according to claim 2, wherein the breaking force of said second weft yarns (4) is 3 to 5 times less than the breaking force of said first weft yarns (3).

4. The clothing article according to claim 1, wherein a yarn count of said second weft yarns (4) is 5 to 8 times less than a yarn count of said first weft yarns (3).

5. The clothing article according to claim 1, wherein said second weft yarns (4) extend to form over portions (7) along the front side (5) of the fabric by passing over three or more warp yarns (2).

6. The clothing article according to claim 5, wherein said second weft yarns (4) extend to form over portions (7) along the front side (5) of the fabric by passing over up to twenty warp yarns (2).

7. The clothing article according to claim 1, wherein said first weft yarns (3) extend to form under portions (8) along the back side (6) of the fabric by passing below two or more warp yarns (2).

8. The clothing article according to claim 1, wherein said second weft yarns (4) are made by single yarns and wherein said warp yarns (2) and/or said first weft yarns are made by single and/or twisted yarns.

9. The clothing article according to claim 1, wherein said second weft yarns (4) have different color with respect to said first weft yarns (3) and/or said warp yarns (2).

10. The clothing article according to claim 1, wherein said second weft yarns (4) are made by a different material with respect to said first weft yarns (3) and/or said warp yarns (2).

11. The clothing article according to claim 1, wherein the fabric is a denim fabric.

12. The clothing article according to claim 1, wherein said warp yarns (2) and said first weft yarns (3) are woven to form a warp faced twill fabric.

13. A woven fabric (1) comprising warp yarns (2) and weft yarns (3, 4) woven together, said fabric having a front side (5) and a back side (6), wherein: said weft yarns comprise a plurality of first weft yarns (3) and at least one plurality of second weft yarns (4); said plurality of warp yarns (2) and said plurality of first weft yarns (3) form a base layer (1*a*) of said fabric; and said at least one plurality of second weft yarns (4) form an additional layer (1*b*) of said fabric in the form of over portions (7), characterized in that said an additional layer (1*b*) is located on the front side (5) of the fabric and in that said first (3) and second (4) weft yarns are different and are selected give a different behaviour with respect to a same stress applied to an area of said fabric, so that at least part of said second weft yarns (4) in said additional layer (1*b*) of the fabric breaks under said stress applied to at least one area (11) of said fabric and at least said first weft yarns (3) of said base layer (1*a*) within said areas (11) withstand the said stress, wherein the breaking force of said second weft yarns (4) is lower than the breaking force of said first weft yarns (3) and wherein said second weft yarns (4) extend to form over portions (7) along the front side (5) of the fabric by passing over three or more warp yarns (2), and wherein at least a portion of the second weft yarns are broken and at least part of at least some of the broken second weft yarns are removed from the fabric.

14. The clothing article according to claim 1, wherein said second weft yarns (4) extend to form over portions (7) along the front side (5) of the fabric by passing over five or more warp yarns (2).

15. The clothing article according to claim 1, wherein said second weft yarns (4) extend to form over portions (7) along the front side (5) of the fabric by passing over seven or more warp yarns (2).

16. The clothing article according to claim 5, wherein said second weft yarns (4) extend to form over portions (7) along the front side (5) of the fabric by passing over up to fifteen warp yarns (2).

17. The clothing article according to claim 5, wherein said second weft yarns (4) extend to form over portions (7) along the front side (5) of the fabric by passing over a maximum of 12 warp yarns.

18. The clothing article according to claim 1, wherein the fabric is an indigo dyed denim fabric.

19. The clothing article according to claim 1, wherein a ratio of a breaking force of the first weft yarns to a breaking force of the second weft yarns is in a range of 2:1 to 7:1.

* * * * *